United States Patent [19]

Akizawa

[11] 3,938,534

[45] Feb. 17, 1976

[54] APPARATUS FOR WASHING CEREALS

[76] Inventor: Nobuo Akizawa, Horinouchi 3-44-7, Suginami, Tokyo, Japan

[22] Filed: Aug. 1, 1974

[21] Appl. No.: 493,700

[52] U.S. Cl. ..... 134/104; 134/25 R; 134/133; 134/179; 134/187; 259/8; 259/24; 259/64

[51] Int. Cl.[2] ..... B08B 3/02

[58] Field of Search.. 134/25 R, 104, 109, 132–133, 134/179, 187; 259/8, 24, 64

[56] References Cited

UNITED STATES PATENTS

| | | | |
|---|---|---|---|
| 2,246,674 | 6/1941 | Gronemeyer | 134/104 |
| 2,304,744 | 12/1942 | Snyder | 134/133 |
| 2,862,511 | 12/1958 | Forsberg | 134/187 |
| 3,038,482 | 6/1962 | Mylting et al. | 134/104 X |
| 3,202,281 | 8/1965 | Weston | 259/8 X |
| 3,502,305 | 3/1970 | Grün | 259/8 |
| 3,802,916 | 4/1974 | Jackson | 134/104 X |

FOREIGN PATENTS OR APPLICATIONS

| | | | |
|---|---|---|---|
| 1,131,938 | 3/1957 | France | 134/25 |

*Primary Examiner*—Robert L. Bleutge
*Attorney, Agent, or Firm*—Oldham & Oldham Co.

[57] ABSTRACT

An apparatus for washing cereals to wash them in a cereal washing tank by a jet water rotor. The invention includes collecting the water-cereal mix and removal of the heavier cereals from the mix which overflows a receiver to remove lighter weight wastes.

7 Claims, 6 Drawing Figures

Fig. 5A
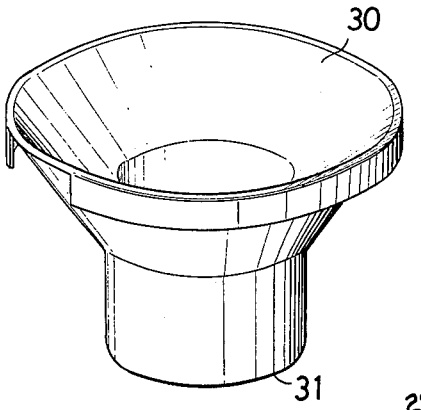
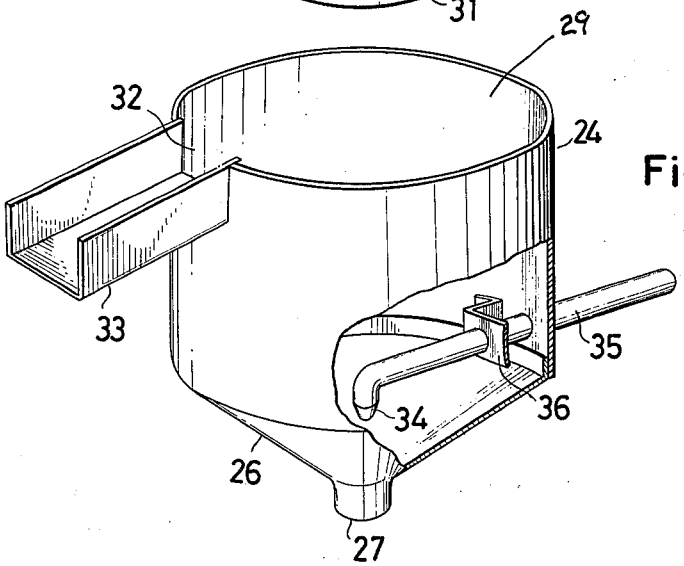
Fig. 5B

APPARATUS FOR WASHING CEREALS

SUMMARY OF THE INVENTION

This invention relates to an apparatus for washing cereals.

An object of the invention is to wash cereals by pressured water, such as that of the water supply, without use of other power means in washing cereals.

Another object of the invention is to wash cereals continuously in small quantities as gradually supplied to a washing compartment from a supply hopper.

A further object of the invention is to provide an apparatus for separating washed cereals from slops and other unwanted matter by exhausting such unwanted matter.

Other objects of the invention are to provide an apparatus for washing cereals with a very small quantity of energy by washing them in small quantities; to wash continuously by supplying cereals from a hopper to a washing chamber; and to use two different zones in the apparatus for washing and separation actions.

An apparatus according to this invention has merit for washing cereals without causing them to crack or scratch each other owing to no application of large pressures thereto and by using minimum power in the washing action.

BRIEF DESCRIPTION OF THE SEVERAL VIEWS OF DRAWINGS

This invention will be better understood from the following description taken, in connection with the accompanying drawings, in which:

FIG. 5A is a perspective view of the screening member and 5B is a perspective view of the cylindrical body of the second wash chamber partly broken away.

DETAILED DESCRIPTION OF THE INVENTION

Figure 1:
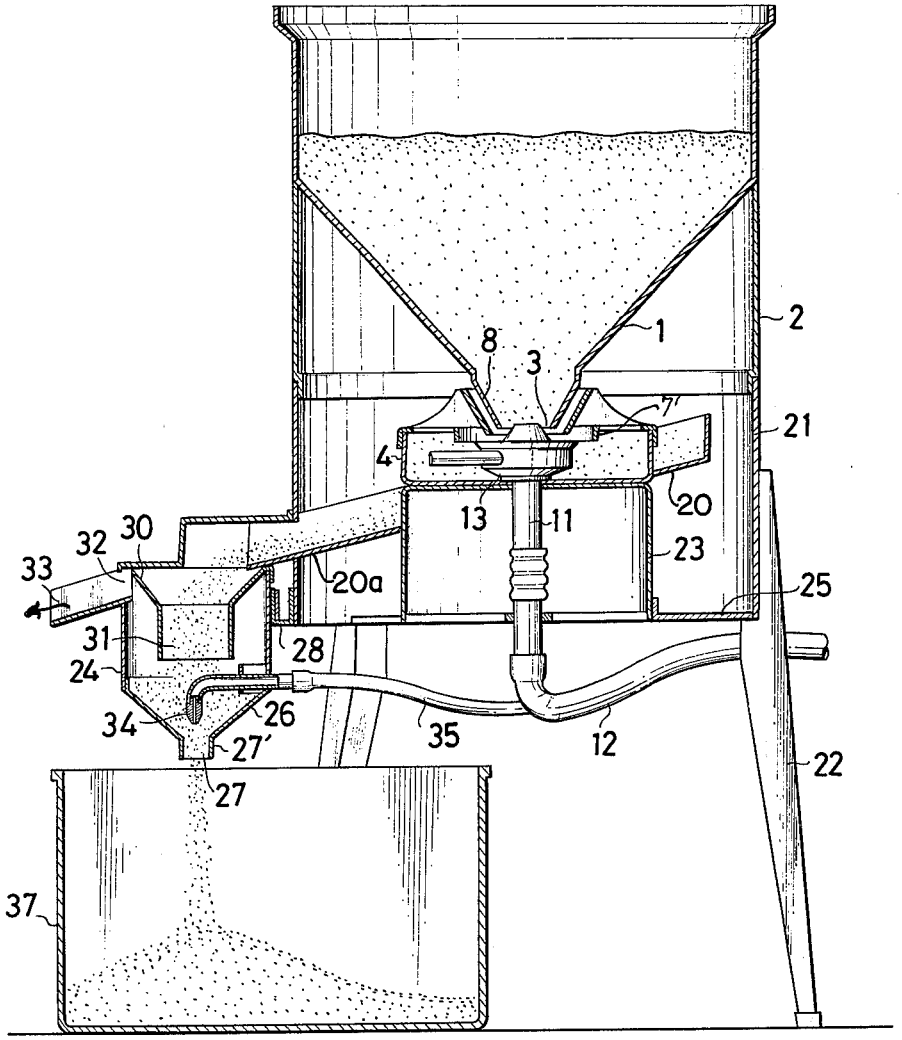
FIG. 1 is a vertical section of an illustrative embodiment of this invention.
Figure 2:
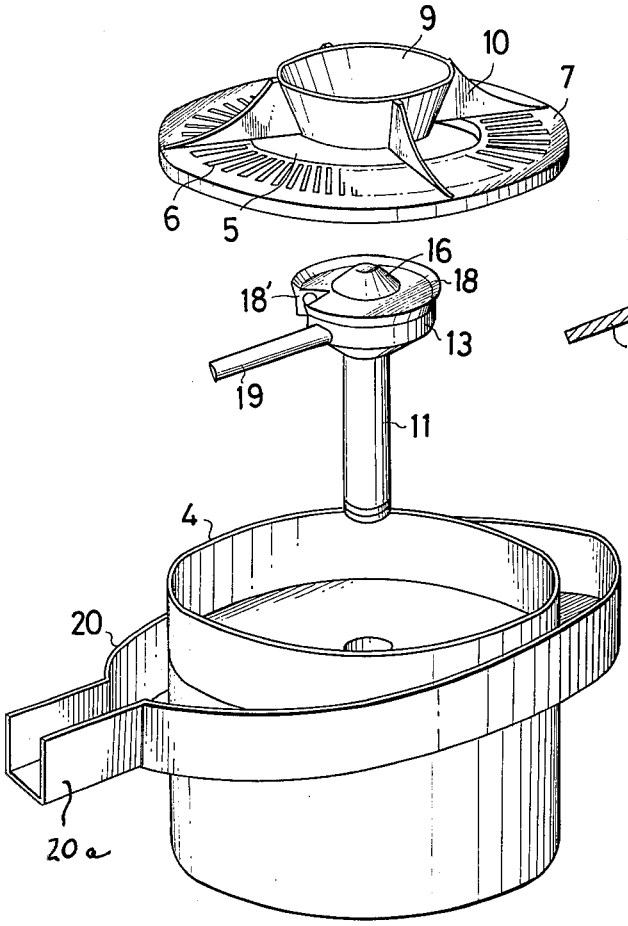
FIG. 2 is a perspective, exploded view of the rotary wash chamber means of FIG. 1.
Figure 3:
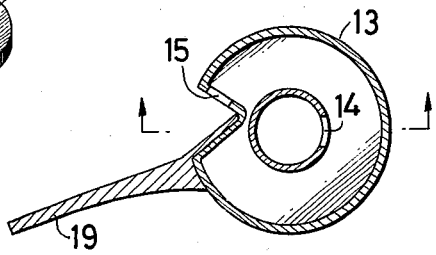
FIG. 3 is a horizontal section of the rotor member, taken on line 3—3 of FIG. 4.
Figure 4:
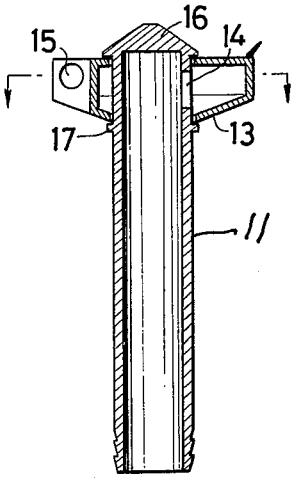
FIG. 4 is a vertical section of the rotor member and support.

This invention relates to an apparatus for washing cereals and separating washed cereals from slops, impurities, and other undesirable matter.

Referring now to the drawings, there is illustrated therein a preferred embodiment of this invention.

The numeral 1 indicates a hopper, supported by a side wall 2 having an opening 3 at the lower end thereof, the hopper being of funnel shape.

The numeral 4 indicates a cereal-washing tank or chamber member positioned under the opening 3 of the lower part of the hopper, and having a cover 7. The cover 7 has an opening 5 at its center and many through slots 6, 6 extending radially of the cover.

Over the opening 5 of the said cover 7, a conical supporting member 9 is positioned by flanges 10 on the cover, and the supporting member 9 fits against or is quite close to the side wall 8 of the lower part of the hopper 1.

The numeral 7' indicates an annular vertical flange outlining the opening 5 of the cover 7.

The numeral 11 indicates a tube inserted through the lower center of the cereal washing tank 4, to which a hose 12 connects for connection to a water supply source such as a faucet.

The numeral 13 indicates a rotor carried by the tube 11 and designed so as to rotatingly move around a hole 14 bored in the tube 11. A jet hole 15 of suitable size is made in an indented wall of the rotor and the hole has an axis nearly perpendicular to a radius of the hollow tube 11.

The rotor 13 is positioned only a short distance from the opening 3 at the lower part of the hopper 1 to permit cereals to pass thereto. A head part 16 of the tube 11 projects into the opening 3 to prevent cereals in the hopper 1 from freely continuously dropping out of the hopper.

The said rotor 13 is supported at the upper part and the lower part thereof by the head part 16 and a ring 17, respectively, for rotation on the tube.

The said rotor 13 is provided with an upstanding edge plate 18 at the outer circumference of the upper part thereof and with a control arm 19 extending from the side thereof to regulate the rotation of the rotor 13 as hereinafter described.

The rotation of the rotor 13 can be also controlled by making a small hole symmetric to the jet hole 15 in place of this control arm 19 which stirs the contents of the tank.

The numeral 20 indicates a conduit means made with a downward inclination engaging the outer circumference of the cereal washing tank 4, and having a narrow fore end or discharge spout 20a. Such conduit encompasses the tank 4 and is below its top edge.

The numeral 21 indicates a support with the upper part thereof fitted to the side wall 2 and feet 22, 22 fixed thereto.

The support 21 and the cereal washing tank 4, and its base 23, are fixedly supported by a plate 25.

The numeral 24 indicates a cylindrical body having an opening 29 at its upper end and being formed in a funnel shape 26 at the lower part thereof, at the center of which a small hole 27 is provided.

The said cylindrical body 24 is fixed to the wall body or support 21 by an attaching plate 28 to be positioned to receive discharge from the conduit 20.

The numeral 30 indicates a screening or flow control member substantially formed in a funnel shape, with the upper part thereof fixed to the top of the cylindrical body 24 and open at its end 31. The member 30 is positioned at the middle axis of the cylindrical body 24 and extends downwardly in the cylindrical section of such body but terminates above its lower end.

The numeral 32 indicates an exhaust or overlow opening at the upper part of the side wall of the cylindrical body 24 and to which is connected a conduit 33.

The numeral 34 indicates a jet hole made at the fore end of a water supply tube 35 inserted through the side part of the cylindrical body 24, and positioned over the small hole 27. The said jet hole 34 is positioned so as to face toward the center of the small hole 27 but it may be made otherwise; that is, by boring several jet holes directed toward the side wall 27' of the small hole 27. The water supply tube 35 may connect to a hose 12 or be connected directly to the water supply faucet.

The water supply tube 35 is fixed to the said cylindrical body 24 by a bracket 36.

The numeral 37 is a collecting container.

Now, an explanation for use and the actions of this apparatus is to be made, and the opening 3 of the lower part of the hopper 1 is positioned close to the rotor 13 so as to receive the head part 16 of the tube 11 therein when fitting the side wall 2 in the support 21. When cereals are put in the hopper 1, they fall to the opening 3 and are dropped onto the rotor 13 through the small gap between the opening 3 and the head part 16 of the tube 11. But, after a certain quantity of cereals has dropped, then the rotor or its head 13 is filled with cereals to choke the opening 3. Such action is aided by the existence of the flange 18 on the rotor. Thereafter, cereals are prevented from dropping from the hopper 1. Then or beforehand, the hose is connected to the faucet of the water supply for release of water, water passing from the tube 11 to the rotor 13 through the hole 14 and being jetted from the jet hole 15 of the rotor 13.

By this reaction of the jet power, the rotor 13 is made to rotate, by which cereals on the rotor 13 are progressively dropped from a cutoff part of the rotor and fence plate 18' into the cereal washing tank 4. Then no cereal is on the rotor 13, or the head part 16 of the tube 11 and cereals in the hopper 1 will progressively and/or continuously slowly feed onto the rotor 13, as the opening 3 is cleared of prior cereal therein.

In such a way, cereals in the hopper 1 are slowly supplied continuously to the cereal washing tank 4 with the rotation of the rotor 13.

Cereals dropping in the cereal washing tank 4 are moved around and collide each other by water jetting from the jet hole 15 of the rotor 13 to flow around the cereal washing tank 4 with the water, thereby causing the cereal particles to be gradually washed and cleaned. At this time, the vertical flange 7' of the cover 7 retains cereals in the tank 4 so as to prevent them from flowing directly out of the opening 5 and to retain them for adequate washing. Moreover, during this time, water overflows the cereal washing tank 4 from the slots 6 and opening 5 of the cover 7 into the conduit 20 positioned around the cereal washing tank 4. If desired, the upper edge of the tank 4 can be lower than the upper edge of the cover flange 7' and the cover 7 be shaped to have its slotted peripheral portion lower than the top of such flange 7' but above the flat upper surface of the rotor 13. The washing can be nearly completed by this apparatus described above, and be completed by depositing them in a container to allow water to drip therefrom. But, as described below, cereals may be received in the container 37 after separating slops or other impurities therefrom. That is, together with the carrier water, cereals washed in the cereal washing tank 4 overflow to drop in order from the cover 7 through the conduit 20 to the screening member 30. Some cereal particles slip down into the cylindrical body 24 after colliding with the screening member 30 and some of them drop directly into the cylindrical body 24 through the opening 31 of the screening member 30.

The small hole 27 of the cylindrical body 24 is formed so small in relation to the volume and quantity of washed cereals, slops and water flowing in that some washed cereals and slops will stay in the cylindrical body 24. The water supply tube 35 provides water under pressure so clean water is jetted from the jet hole 34 on the central axis of the small hole 27. Therefore, cereal particles are floatingly moved around in the cylindrical body 24 and sink to near the small hole 27 by their weight.

Then, the water being jetted at the small hole 27, even if slops or waste water are in the body 24, will be diluted rapidly. Moreover, cereals near the small hole 27 are washed by the jet water flow, simultaneously with which water and cereals are exhausted from the small hole 27 by the jet power and gravity to drop into the container 37 previously positioned under the hole 27.

In such a way, cereals flowing into the cylindrical body 24, having greater specific gravity than water, sink down near the small hole 27 to be exhausted from the small hole 27 by the auxiliary power of jet water from the jet hole 34. Hence, cereals and washing water flowing from the conduit 20 gradually pass to and through the cylindrical body 24 together with water jetted from the jet hole 34. The water level in the body 24 in use gradually goes up to reach the overflow port 32, and the water exhausted through the conduit 33 increases in quantity.

Rice bran, dust, and the like, and other objects floating on the water are called "slops" and are in the cylindrical body 24 to exhaust progressively with the water from the upper part thereof by exhaust opening 32. Cereals together with clean water flow from the small hole 27.

Moreover, this apparatus can be used alone as a cereal washing apparatus by passing water and cereals in order through several units of this apparatus, or by repeatedly passing through them through one unit.

In such a way, during rotation of the rotor 13, cereals in the hopper 1 are continuously supplied and washed in the cereal washing tank 4 to be collected in the container 37.

When stopping a washing action, by stopping the water supply, rotation of the rotor 13 is stopped, causing cereals on the rotor 13 to choke the opening 3 of the lower part of the hopper 1 to stop the supply of cereals. When finishing a quantity of cereals, they are exhausted from the cereal washing tank by rotation of the rotor 13 to be ultimately collected in the container 37 for any desired further treatment.

The process includes collecting the water cereal mix in a chamber 24, controlling bottom discharge from the chamber to build up the volume therein and overflowing the chamber for discharge of slops. Also, means are positioned at the bottom of the hopper to provide limited continuous cereal discharge dependant upon the processing rate and automatically terminating cereal discharge when cereal is not progressing through the apparatus.

According to this invention described above, an apparatus is provided that is relatively simple and it automatically supplies cereals in quantity that can be washed continuously. Moreover, it is compact and light in weight.

While one complete embodiment of the invention has been disclosed herein, it will be appreciated that modification of this particular embodiment of the invention may be resorted to without departing from the scope of the invention.

What is claimed is:

1. An apparatus for washing cereals comprising in combination, a hopper of reduced size at the lower part thereof, and having an opening at its bottom, a cereal washing tank positioned under the opening and larger than the opening, the said opening being no lower than that of a cover on the tank, which cover has an opening therein, a hollow water supply tube projecting into the cereal washing tank, and a hollow rotor on said tube and connecting to said tube, the rotor having an upper vertically extending flange plate with a notch at the upper edge thereof and having a jet hole in the rotor for water discharge to rotate the rotor, and the top of the rotor extending into the opening in the lower part of the hopper to reduce the discharge area thereof.

2. An apparatus as in claim 1 and including an open ended vertically positioned cylindrical member having a reduced area lower end with a relatively small discharge opening therein, a conduit collecting overflow cereal-water mix from said tank and flowing it to the upper end of said cylindrical member, and a jet water stream supply member extending into said cylindrical member for directing the stream towards said discharge opening to aid in discharge of cereal and clean water therefrom.

3. Apparatus as set forth in claim 1 wherein the rotor is equipped with a jet hole having an axis nearly perpendicular to a radius of the rotor.

4. Apparatus as set forth in claim 1 wherein a control arm, to control the revolution of the rotor, is secured to and projects out at the side of the rotor.

5. Apparatus as set forth in claim 1 wherein the revolution of the rotor is controlled by providing a small hole in the rotor at the position symmetrical to the jet hole.

6. Apparatus as set forth in claim 1 wherein the cover fits over the cereal washing tank by aid of a holding member engaging the lower outer part of the hopper and projecting above the central opening.

7. An apparatus as set forth in claim 1 wherein the cereals are supplied from the hopper only when dropping from the top of the rotor by the revolution of the rotor, and the rotor and the head part of the tube are positioned near to the lower opening of the hopper, and the rotor is positioned in the cereal washing tank below the upper edge thereof.

* * * * *